US012656033B2

(12) United States Patent
Li et al.

(10) Patent No.: US 12,656,033 B2
(45) Date of Patent: Jun. 16, 2026

(54) AIR CONDITIONING SYSTEM, AIR CONDITIONER OUTDOOR UNIT AND COMPRESSOR ASSEMBLY

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Hongwei Li, Foshan (CN); Mingren Wang, Foshan (CN); Yunxiao Ding, Foshan (CN); Zhijun Tan, Foshan (CN); Kongxiang Wu, Foshan (CN); Yunpeng Jiang, Foshan (CN); Yusheng Zhang, Foshan (CN); Huayong Li, Foshan (CN); Jianhong Lu, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefel (CN)

( * ) Notice: Subject to any disclaimer, the term of this patent is extended or adjusted under 35 U.S.C. 154(b) by 185 days.

(21) Appl. No.: 18/578,012

(22) PCT Filed: Jun. 2, 2022

(86) PCT No.: PCT/CN2022/096923
§ 371 (c)(1),
(2) Date: Jan. 10, 2024

(87) PCT Pub. No.: WO2023/071196
PCT Pub. Date: May 4, 2023

(65) Prior Publication Data
US 2024/0377115 A1 Nov. 14, 2024

(30) Foreign Application Priority Data
Nov. 1, 2021 (CN) ..... 202111284992.1

(51) Int. Cl.
*F25B 43/02* (2006.01)
*F25B 13/00* (2006.01)
*F25B 31/00* (2006.01)

(52) U.S. Cl.
CPC ..... *F25B 43/02* (2013.01); *F25B 13/00* (2013.01); *F25B 31/004* (2013.01); *F25B 2400/23* (2013.01)

(58) Field of Classification Search
CPC ..... F25B 43/02; F25B 13/00; F25B 2400/23; F25B 31/004
See application file for complete search history.

(56) References Cited

U.S. PATENT DOCUMENTS

2015/0219372 A1 8/2015 Jeong et al.

FOREIGN PATENT DOCUMENTS

CN 203443193 U 2/2014
CN 203478706 U 3/2014
(Continued)

OTHER PUBLICATIONS

Zheng et al. (CN 110360709 B), Multi-split air conditioning system and control method thereof, 2019, Whole document (Year: 2019).*
(Continued)

*Primary Examiner* — Jerry-Daryl Fletcher
*Assistant Examiner* — Keith Stanley Myers
(74) *Attorney, Agent, or Firm* — K&L Gates LLP

(57) ABSTRACT

A compressor assembly includes a first compressor, a second compressor, a first oil separator, a second oil separator, a storage container, a gas-liquid separator, a liquid balance pipe, and a gas balance pipe. The first compressor has a first
(Continued)

air return port, and the second compressor has a second air return port. The first oil separator has a first oil outlet, the second oil separator has a second oil outlet, and the storage container has a refrigerant inlet, the first oil outlet and the second oil outlet both being in communication with the refrigerant inlet. The gas-liquid separator has a first gas separation outlet, a second gas separation outlet, a first oil return hole and a second oil return hole, the first gas separation outlet and the first oil return hole both being in communication with the first gas return port.

20 Claims, 3 Drawing Sheets

(56) References Cited

FOREIGN PATENT DOCUMENTS

| | | | | |
|---|---|---|---|---|
| CN | 104457030 | A | | 3/2015 |
| CN | 105371530 | A | | 3/2016 |
| CN | 109210837 | A | | 1/2019 |
| CN | 110319619 | A | | 10/2019 |
| CN | 110360709 | A | | 10/2019 |
| CN | 215675591 | U | | 1/2022 |
| CN | 216557746 | U | | 5/2022 |
| JP | 2001349629 | A | | 12/2001 |
| JP | 2013217623 | A | * | 10/2013 |
| JP | 2014228177 | A | | 12/2014 |
| JP | 5940489 | B2 | | 6/2016 |

OTHER PUBLICATIONS

Guo et al. (CN 104457030 A), Oil way system for parallel-connection type air conditioning unit and parallel-connection type air conditioning unit, 2015, Whole document (Year: 2015).*

Sata (JP 2013217623 A), Accumulator and refrigeration cycle device, 2013, Whole document (Year: 2013).*

Zou et al. (CN 110319619 A), Control method and refrigerating system for multi-split air conditioner and air conditioner, 2019, Whole document (Year: 2019).*

First OA received in CN Application No. 202111284992.1; mailed Jun. 28, 2024.

Second OA received in CN Application No. 202111284992.1; mailed Jul. 18, 2024.

Supplementary European search report received in the counterpart European application 22885105.1, mailed Apr. 23, 2024.

ISR received in PCT/CN2022/096923; mailed Sep. 1, 2022.

* cited by examiner

AIR CONDITIONING SYSTEM, AIR CONDITIONER OUTDOOR UNIT AND COMPRESSOR ASSEMBLY

CROSS-REFERENCES TO RELATED APPLICATIONS

The present disclosure is a national phase application of International Application No. PCT/CN2022/096923, filed on Jun. 2, 2022, which claims priority to Chinese Patent Application No. 202111284992.1, filed on Nov. 1, 2021, the entire content of which is incorporated herein by reference.

FIELD

This application relates to the field of air conditioning equipment, and more particularly to an air conditioning system, an air conditioner outdoor unit, and a compressor assembly.

BACKGROUND

With social development and technological progress, multi-unit heat pump air conditioning systems have increasing capacity. However, with the increase in the capacity, the multi-unit heat pump air conditioning systems also face problems such as insufficient volume for gas separation and difficulty in recovering refrigeration oil, which limit the development of the multi-unit heat pump air conditioning systems. In the related art, parallel connection is adopted for gas separation to expand the capacity of the air conditioning system, which solves the problem of insufficient gas separation volume, but leads to poor reliability of compressor operation.

SUMMARY

The present disclosure aims to solve at least one of the problems existing in the related art to a certain extent.

Accordingly, embodiments of the present disclosure propose a compressor assembly. The compressor assembly according to embodiments of the present disclosure includes: a first compressor including a first exhaust port and a first gas return port; a second compressor including a second exhaust port and a second gas return port; a first oil separator including a first oil outlet and a first oil separator inlet, the first oil separator inlet being connected to the first exhaust port; a second oil separator including a second oil outlet and a second oil separator inlet, the second oil separator inlet being connected to the second exhaust port; a storage container having an accommodation chamber and including a refrigerant inlet connected to the accommodation chamber, wherein the first oil outlet and the second oil outlet are each connected to the refrigerant inlet; a gas-liquid separator having a separation chamber and including a first gas separator outlet, a second gas separator outlet, a first oil return hole and a second oil return hole, wherein the first gas separator outlet and the first oil return hole are each connected to the first gas return port, and the second gas separator outlet and the second oil return hole are each connected to the second gas return port; and a liquid balance pipe and a gas balance pipe above the liquid balance pipe, wherein a first end of the liquid balance pipe and a first end of the gas balance pipe are both connected to the accommodation chamber, while a second end of the liquid balance pipe and a second end of the gas balance pipe are both connected to the separation chamber.

Embodiments of the present disclosure propose an air conditioner outdoor unit. The air conditioner outdoor unit according to embodiments of the present disclosure includes: a four-way valve, including a first interface, a second interface, a third interface, and a fourth interface; an outdoor heat exchanger, a first port of the outdoor heat exchanger being connected to the first interface; and the compressor assembly according to any one of the above embodiments. The first oil separator includes a first oil separator outlet, and the second oil separator includes a second oil separator outlet; the first oil separator outlet and the second oil separator outlet are each connected to the second interface; and the refrigerant inlet is connected to the fourth interface.

Embodiments of the present disclosure propose an air conditioning system. The air conditioning system according to embodiments of the present disclosure includes: an air conditioner outdoor unit according to any one of the above embodiments; and an air conditioner indoor unit including an indoor heat exchanger, wherein a second port of the outdoor heat exchanger is connected to a first port of the indoor heat exchanger, and a second port of the indoor heat exchanger is connected to the third interface.

Figure 1:
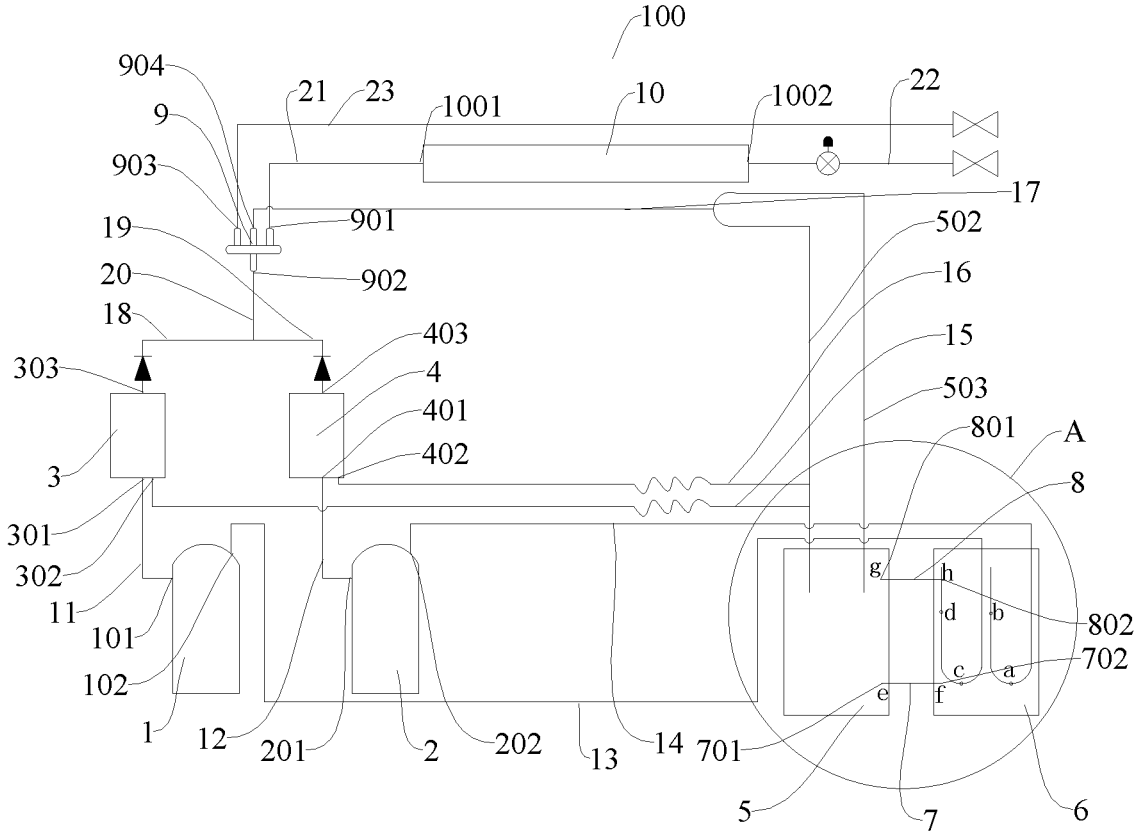
FIG. 1 is a schematic view of an air conditioner outdoor unit according to some embodiments of the present disclosure.

REFERENCE NUMERALS air conditioner outdoor unit 100;

first compressor 1; first exhaust port 101; first gas return port 102;

second compressor 2; second exhaust port 201; second gas return port 202;

first oil separator 3; first oil separator inlet 301; first oil outlet 302; first oil separator outlet 303;

second oil separator 4; second oil separator inlet 401; second oil outlet 402; second oil separator outlet 403;

storage container 5; casing 501; accommodation chamber 5011; first gas inlet pipe 502; first refrigerant inlet 5021; second gas inlet pipe 503; second refrigerant inlet 5031;

gas-liquid separator 6; cylinder 601; separation chamber 6011; first gas outlet pipe 602; first gas separator outlet 6021; first oil return hole 6022; third oil return hole 6023; second gas outlet pipe 603; second gas separator outlet 6031; second oil return hole 6023; fourth oil return hole 6033;

liquid balance pipe 7; first end 701; second end 702; first pipe segment 703; second pipe segment 704; third pipe segment 705;

gas balance pipe 8; third end 801; fourth end 802;

four-way valve 9; first interface 901; second interface 902; third interface 903; fourth interface 904;

outdoor heat exchanger 10; first port 1001; second port 1002;

first pipe 11; second pipe 12; third pipe 13; fourth pipe 14; fifth pipe 15; sixth pipe 16; seventh pipe 17; eighth pipe 18; ninth pipe 19; tenth pipe 20; eleventh pipe 21; twelfth pipe 22; thirteenth pipe 23.

DETAILED DESCRIPTION OF THE DISCLOSURE

Embodiments of the present disclosure will be described in detail below, and examples of the embodiments will be shown in the accompanying drawings. The embodiments described below are exemplary and are intended to explain the present disclosure rather than limit the present disclosure.

A compressor assembly according to embodiments of the present disclosure will be described below with reference to the accompanying drawings.

Figure 2:
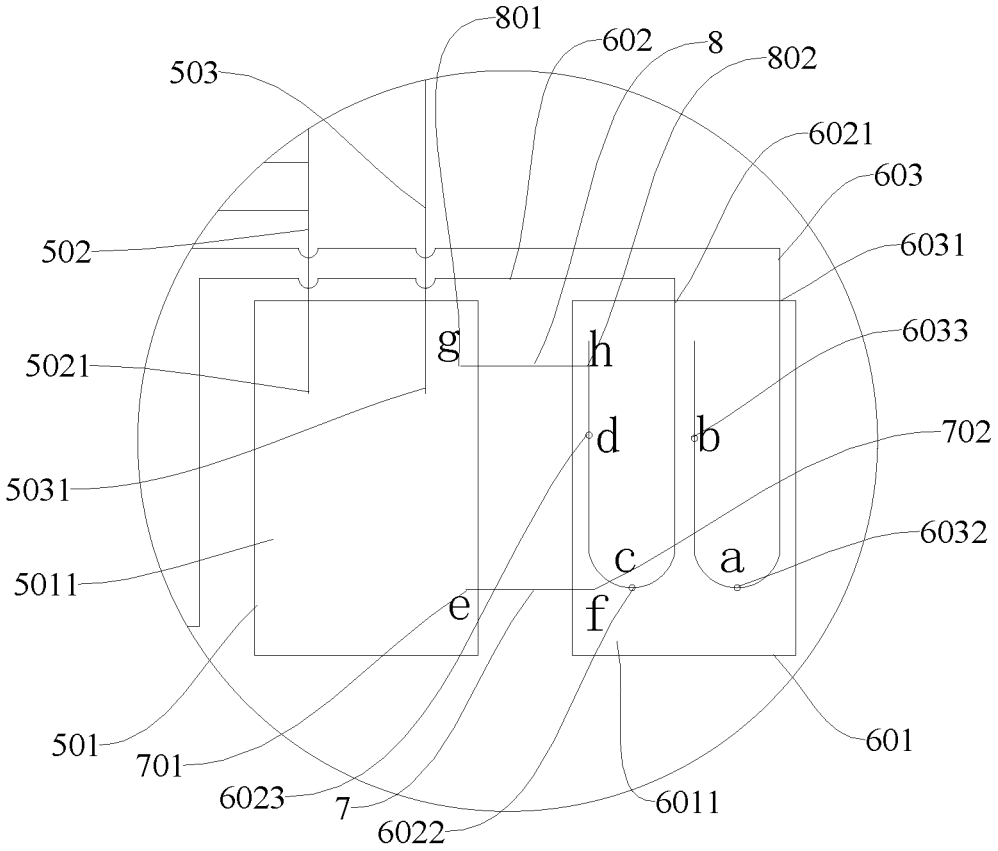
FIG. 2 is an enlarged view of part A in FIG. 1.
Figure 3:
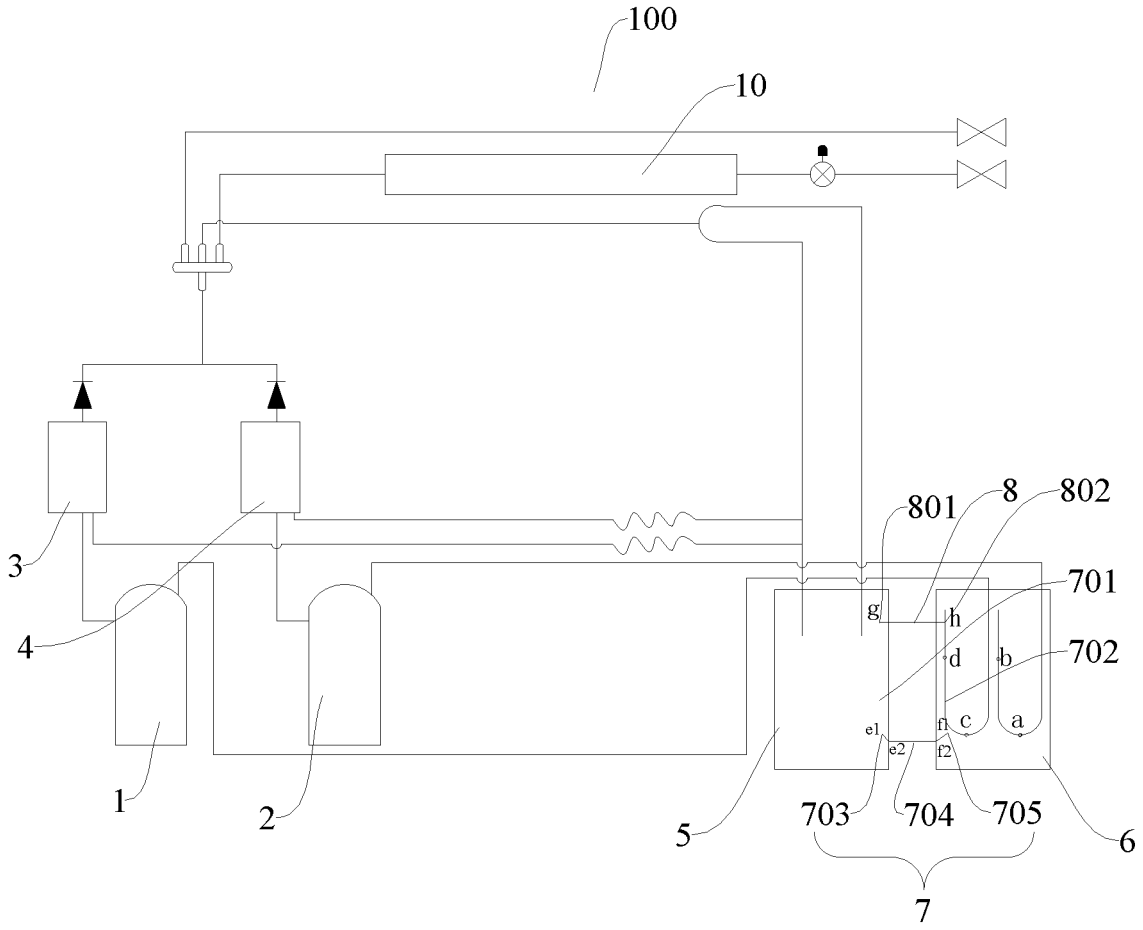
FIG. 3 is a schematic view of an air conditioner outdoor unit according to some other embodiments of the present disclosure.

As shown in FIGS. 1 to 3, the compressor assembly according to embodiments of the present disclosure include a first compressor 1, a second compressor 2, a first oil separator 3, a second oil separator 4, a storage container 5, a gas-liquid separator 6, a liquid balance pipe 7, and a gas balance pipe 8.

The first compressor 1 has a first exhaust port 101 and a first gas return port 102. The second compressor 2 has a second exhaust port 201 and a second gas return port 202. The first oil separator 3 has a first oil outlet 302 and a first oil separator inlet 301 that is connected to the first exhaust port 101. The second oil separator 4 has a second oil outlet 402 and a second oil separator inlet 401 that is connected to the second exhaust port 201.

The storage container 5 has an accommodation chamber 5011 and includes a refrigerant inlet (a first refrigerant inlet 5021 and a second refrigerant inlet 5031) connected to the accommodation chamber 5011. The first oil outlet 302 and the second oil outlet 402 are each connected to the refrigerant inlet. The gas-liquid separator 6 has a separation chamber 6011 and includes a first gas separator outlet 6021, a second gas separator outlet 6031, a first oil return hole 6022 and a second oil return hole 6023. The first gas separator outlet 6021 and the first oil return hole 6022 are each connected to the first gas return port 102. The second gas separator outlet 6031 and the second oil return hole 6023 are each connected to the second gas return port 202.

The gas balance pipe 8 is above the liquid balance pipe 7. In some embodiments, the gas balance pipe 8 being above the liquid balance pipe 7 means that when the storage container 5 and the gas-liquid separator 6 are in use, the gas balance pipe 8 is above the liquid balance pipe 7.

One end of the liquid balance pipe 7 and one end of the gas balance pipe 8 are both connected to the accommodation chamber 5011, while the other end of the liquid balance pipe 7 and the other end of the gas balance pipe 8 are both connected to the separation chamber 6011. For example, as shown in FIGS. 1 to 3, the liquid balance pipe 7 has a first end 701 and a second end 702 opposite to each other in its length direction; the gas balance pipe 8 has a third end 801 and a fourth end 802 opposite to each other in its length direction. The first end 701 and the third end 801 are each connected to the accommodation chamber 5011; and the second end 702 and the fourth end 802 are each connected to the separation chamber 6011.

Consequently, the use of the liquid balance pipe 7 and the gas balance pipe 8 can achieve connection between the accommodation chamber 5011 and the separation chamber 6011, to achieve liquid balance and gas balance between the accommodation chamber 5011 and the separation chamber 6011. Thus, gaseous substances in the accommodation chamber 5011 can enter the separation chamber 6011 through the gas balance pipe 8, and liquid substances in the accommodation chamber 5011 can enter the separation chamber 6011 through the liquid balance pipe 7.

During operation of the compressor assembly according to embodiments of the present disclosure, refrigerant vapor containing refrigeration oil (first oil-containing refrigerant vapor) flowing out of the first exhaust port 101 of the first compressor 1 enters the first oil separator 3 through the first oil separator inlet 301, and the first oil-containing refrigerant vapor is separated into first refrigerant vapor and first refrigeration oil in the first oil separator 3. The first refrigeration oil enters the accommodation chamber 5011 of the storage container 5 through the first oil outlet 302 and the refrigerant inlet, and the first refrigerant vapor enters an indoor heat exchanger for heat exchange. Meanwhile, refrigerant vapor containing refrigeration oil (second oil-containing refrigerant vapor) flowing out of the second exhaust port 201 of the second compressor 2 enters the second oil separator 4 through the second oil separator inlet 401, and the second oil-containing refrigerant vapor is separated into second refrigerant vapor and second refrigeration oil in the second oil separator 4. The second refrigeration oil enters the accommodation chamber 5011 of the storage container 5 through the second oil outlet 402 and the refrigerant inlet, and the second refrigerant vapor enters the indoor heat exchanger for heat exchange.

In addition, a part of the refrigerant (a third refrigerant), which flows out of the indoor heat exchanger and needs to return to the first compressor 1 and the second compressor 2, enters the accommodation chamber 5011 of the storage container 5 through the refrigerant inlet; and another part of the refrigerant (a fourth refrigerant), which flows out of the indoor heat exchanger and needs to return to the first compressor 1 and the second compressor 2, enters the accommodation chamber 5011 of the storage container 5 through the refrigerant inlet.

Next, in a suction process of the first compressor 1 (the third refrigerant and the fourth refrigerant), the refrigeration oil in the separation chamber 6011 can return to the first compressor 1 through the first oil return hole 6022, the first gas separator outlet 6021 and the first gas return port 102; in a suction process of the second compressor 2 (the third refrigerant and the fourth refrigerant), part of the refrigeration oil in the separation chamber 6011 can return to the second compressor 2 through the second oil return hole 6032, the second gas separator outlet 6031 and the second gas return port 202. Thus, recovery of refrigeration oil in the first compressor 1 and the second compressor 2 can be realized.

For the compressor assembly that returns oil through the gas-liquid separator, there is a relationship between the return oil volume of the compressor and the suction volume of the compressor—the return oil volume of the compressor increases with an increase in the suction volume of the compressor, while the return oil volume of the compressor decreases with a decrease in the suction volume of the compressor. Accordingly, when compressors with different capacities are used in a common system, if a deviation among suction volumes of compressors with different capacities is too large (exceeding a design deviation), a deviation in the amount of refrigeration oil returned to the compressor along with refrigerant vapor during the suction process of the compressor will also be large, cause some compressors (usually small-capacity compressors) to suffer from insufficient return oil or inability to return oil, resulting in poor reliability of compressor operation.

For the compressor assembly according to embodiments of the present disclosure, since the first refrigeration oil, the second refrigeration oil, the third refrigerant, and the fourth refrigerant all first enter the accommodation chamber 5011 of the storage container 5, and then enter the separation chamber 6011 of the gas-liquid separator 6 through the liquid balance pipe 7 and the gas balance pipe 8, it can be ensured that there is refrigeration oil and refrigerant in the separation chamber 6011 where the first oil return hole 6022 and the second oil return hole 6032 are located, and ambient pressure at which the first oil return hole 6022 is equal to ambient pressure at which the second oil return hole 6032 is. Thus, it is possible to reduce or even avoid a large refrigerant distribution deviation (i.e., there is a large amount of refrigerant at the gas separator inlet of the gas-liquid separator corresponding to the large capacity compressor, while there is very little refrigerant at the gas separator inlet of the gas-liquid separator corresponding to the small capacity compressor) between the first compressor 1 and the second compressor 2 caused by different capacities of the first compressor 1 and the second compressor 2. Furthermore, the problem of insufficient return oil or even inability to return oil for small capacity compressors due to the different capacities of the first compressor 1 and the second compressor 2 can be relieved or even avoided, to prevent compressor wear for lack of lubrication caused by untimely oil return or inability to return oil, and greatly improving the reliability of the compressor assembly.

Therefore, the compressor assembly according to embodiments of the present disclosure has advantages such as high reliability.

In addition, the storage container 5 according to embodiments of the present disclosure can store excess refrigerant and refrigeration oil, and the gas-liquid separator 6 can not only store excess refrigerant and refrigeration oil, but also achieve oil return of the compressor.

In embodiments of the present disclosure, the storage container may be a gas-liquid separator, and the accommodation chamber may be a separation chamber.

For example, the storage container is called a first gas-liquid separator, and the gas-liquid separator is called a second gas-liquid separator. Consequently, the refrigerant entering the first gas-liquid separator can achieve primary gas-liquid separation using the first gas-liquid separator, then enter the second gas-liquid separator and undergo secondary second gas-liquid separation in the second gas-liquid separator. The first gas-liquid separator can not only achieve gas-liquid separation, but also store excess refrigerant and refrigeration oil; the second gas-liquid separator can realize gas-liquid separation, store excess refrigerant and refrigeration oil, and achieve oil return of the compressor.

In embodiments of the present disclosure, as shown in FIGS. 1 and 2, the compressor assembly includes a first pipe 11, a second pipe 12, a third pipe 13, a fourth pipe 14, a fifth pipe 15, and a sixth pipe 16. The first exhaust port 101 is connected to the first oil separator inlet 301 through the first pipe 11, and the second exhaust port 201 is connected to the second oil separator inlet 401 through the second pipe 12. The first oil outlet 302 is connected to the refrigerant inlet through the fifth pipe 15, and the second oil outlet 402 is connected to the refrigerant inlet through the sixth pipe 16. The first gas separator outlet 5021 is connected to the first return gas outlet 102 through the third pipe 13, and the second gas separator outlet 6021 is connected to the second return gas outlet 202 through the fourth pipe 14.

In some embodiments, the storage container 5 includes a casing 501, and the accommodation chamber 5011 is defined in the casing 501.

The gas-liquid separator 6 includes a cylinder 601, a first gas outlet pipe 602, and a second gas outlet pipe 603. The separation chamber 6011 is defined in the cylinder 601. A part of the first gas outlet pipe 602 and a part of the second gas outlet pipe 603 both extend into the separation chamber 6011. The first oil return hole 6022 is in the part of the first gas outlet pipe 602, and the first gas separator outlet 6021 is in another part of the first gas outlet pipe 602. The second oil return hole 6032 is in the part of the second gas outlet pipe 603, and the second gas separator outlet 6031 is in another part of the second gas outlet pipe 603.

For example, the first gas outlet pipe 602 includes a first portion and a second portion, the first portion extends into the separation chamber 6011, and the second portion is outside the separation chamber 6011. The first oil return hole 6022 is in the first portion of the first gas outlet pipe 602, and the first gas separator outlet 6021 is in the second portion of the first gas outlet pipe 602.

The second gas outlet pipe 603 includes a first portion and a second portion, the first portion extends into the separation chamber 6011, and the second portion is outside the separation chamber 6011. The second oil return hole 6032 is in the first portion of the second gas outlet pipe 603, and the second gas separator outlet 6031 is in the second portion of the second gas outlet pipe 603.

One end of the liquid balance pipe 7 is below the first oil return hole 6022 or at a same height as the first oil return hole 6022, and is below the second oil return hole 6032 or at a same height as the second oil return hole 6032. The other end of the liquid balance pipe 7 is below the first oil return hole 6022 or at a same height as the first oil return hole 6022, and is below the second oil return hole 6032 or at a same height as the second oil return hole 6032.

When the storage container 5 and the gas-liquid separator 6 are in use, one end of the liquid balance pipe 7 is below the first oil return hole 6022 or at a same height as the first oil return hole 6022, and is below the second oil return hole 6032 or at a same height as the second oil return hole 6032; the other end of the liquid balance pipe 7 is below the first oil return hole 6022 or at a same height as the first oil return hole 6022, and is below the second oil return hole 6032 or at a same height as the second oil return hole 6032.

For example, as shown in FIGS. 1 and 2, a bottom wall surface of the accommodation chamber 5011 and a bottom wall surface of the separation chamber 6011 are at the same height. A distance between the first end 701 (*e*) of the liquid balance pipe 7 and the bottom wall surface of the accommodation chamber 5011 is denoted as L1; a distance between the first oil return hole 6022 (*a*) and the bottom wall surface of the accommodation chamber 5011 is denoted as L2; a distance between the second end 702 (*f*) of the liquid balance pipe 7 and the bottom wall surface of the separation chamber 6011 is denoted as L3; and a distance between the second oil return hole 6032 (*c*) and the bottom wall surface of the separation chamber 6011 is L4, in which $L2 \geq L1$, $L4 \geq L1$, $L2 \geq L3$ and $L4 \geq L3$.

Therefore, the height of the liquid balance pipe 7 is not higher than the first oil return hole 6022 and the second oil return hole 6032, effectively ensuring that the refrigeration oil in the accommodation chamber 5011 can enter the separation chamber 6011 through the liquid balance pipe 7, and the refrigeration oil in the separation chamber 6011 can return to the first compressor 1 and the second compressor 2 through the first oil return hole 6022 and the second oil return hole 6032, respectively, which is conducive to further improving the reliability of the compressor assembly.

In embodiments of the present disclosure, as shown in FIGS. 1 to 3, the storage container 5 includes a first gas inlet pipe 502 and a second gas inlet pipe 503. A part of the first gas inlet pipe 502 extends into the accommodation chamber 5011, and a part of the second gas inlet pipe 503 extends into the accommodation chamber 5011. The part of the first gas inlet pipe 502 and the part of the second gas inlet pipe 503 are each provided with a refrigerant inlet. The first oil outlet 302 and the second oil outlet 402 are each connected to the refrigerant inlet of the first gas inlet pipe 502.

For example, the refrigerant inlet of the first gas inlet pipe 502 is the first refrigerant inlet 5021, and the refrigerant inlet of the second gas inlet pipe 503 is the second refrigerant inlet 5031. Each of the first gas inlet pipe 502 and the second gas inlet pipe 503 includes a first portion and a second portion. The first portion of the first gas inlet pipe 502 and the first portion of the second gas inlet pipe 503 both extend into the accommodation chamber 5011. The second portion of the first gas inlet pipe 502 and the second portion of the second gas inlet pipe 503 are located outside the accommodation chamber 5011. The first refrigerant inlet 5021 is in the first portion of the first gas inlet pipe 502, and the second refrigerant inlet 5031 is in the first portion of the second gas inlet pipe 503.

That is, the first refrigerant inlet 5021 serves as both a refrigerant oil inlet and a refrigerant inlet; and the second refrigerant inlet 5031 only serves as a refrigerant inlet.

The first gas inlet pipe 502 and the first oil outlet 302 are connected through the fifth pipe 15, and the second gas inlet pipe 503 and the second oil outlet 402 are connected through the sixth pipe 16.

In some other embodiments of the present disclosure, the storage container 5 includes a first gas inlet pipe 502 and a second gas inlet pipe 503. A part of the first gas inlet pipe 502 and a part of the second gas inlet pipe 503 both extend into the accommodation chamber 5011. The part of the first gas inlet pipe 502 and the part of the second gas inlet pipe 503 are each provided with a refrigerant inlet. The first oil outlet 302 is connected to the refrigerant inlet of the first gas inlet pipe 502, and the second oil outlet 402 is connected to the refrigerant inlet of the second gas inlet pipe 503.

In such a case, the refrigerant inlet of the first gas inlet pipe 502 is the first refrigerant inlet 5021, and the refrigerant inlet of the second gas inlet pipe 503 is the second refrigerant inlet 5031. The first refrigerant inlet 5021 serves as both a refrigerant oil inlet and a refrigerant inlet; and the second refrigerant inlet 5031 serves as both a refrigerant oil inlet and a refrigerant inlet.

In some embodiments of the present disclosure, one end of the liquid balance pipe 7 extends into an interior of the casing 501, and one end of the liquid balance pipe 7 is connected to the accommodation chamber 5011; the other end of the liquid balance pipe 7 extends into an interior of the cylinder 601, and the other end of the liquid balance pipe 7 is connected to the separation chamber 6011.

For example, as shown in FIGS. 1 to 3, the first end 701 of the liquid balance pipe 7 extends into the interior of the casing 501, and the second end 702 of the liquid balance pipe 7 extends into the interior of the cylinder 601.

In some embodiments, the bottom wall surface of the accommodation chamber 5011 and the bottom wall surface of the separation chamber 6011 are at the same height, and one end of the liquid balance pipe 7 and the other end of the liquid balance pipe 7 are at the same height. In other words, the liquid balance pipe 7 is arranged horizontally. The first oil return hole 6022 and the second oil return hole 6032 are at the same height.

For example, as shown in FIGS. 1 to 3, when the bottom wall surface of the accommodation chamber 5011 and the bottom wall surface of the separation chamber 6011 are at the same height, L1=L3 and L2-L4.

Therefore, when the compressor assembly is mounted, it is only necessary to position the bottom wall surface of the accommodation chamber 5011 and the bottom wall surface of the separation chamber 6011 at the same installation height, which facilitates the installation of the compressor assembly.

In embodiments of the present disclosure, each of the liquid balance pipe 7 and the gas balance pipe 8 is a straight pipe.

For example, as shown in FIGS. 1 and 2, the liquid balance pipe 7 is a straight pipe, a connection port between the liquid balance pipe 7 and the storage container 5 is denoted as e, and a connection port between the liquid balance pipe 7 and the gas-liquid separator 6 is denoted as f, in which e and f are at the same height. The first end 701 of the liquid balance pipe 7 and the second end 702 of the liquid balance pipe 7 are both at the same height as the connection port e (the connection port f).

In embodiments of the present disclosure, at least one of the liquid balance pipe 7 and the gas balance pipe 8 is a bent pipe.

For example, as shown in FIG. 3, the liquid balance pipe 7 includes a first pipe segment 703, a second pipe segment 704, and a third pipe segment 705. The second pipe segment 704 is horizontally arranged, and the first and third pipe segments 703 and 705 are both obliquely arranged. One end of the second pipe segment 704 is connected to a lower end of the first pipe segment 703, and the other end of the second pipe segment 704 is connected to a lower end of the third pipe segment 705.

The two ends of the second pipe segment 704 are connected to the storage container 5 and the gas-liquid separator 6, respectively. A connection port between the second pipe segment 704 and the storage container 5 is denoted as e2; and a connection port between the second pipe segment 704 and the gas-liquid separator 6 is denoted as f2. The first pipe segment 703 extends into the accommodation chamber 5011, and the third pipe segment 705 extends into the separation chamber 6011. An end e1 of the first pipe segment 703 away from the second pipe segment 704 is the first end 701, and an end f1 of the third pipe segment 705 away from the second pipe segment 704 is the second end 702. In such a case, the connection port e2 and the end e1 are at different heights, and the connection port f2 and the end f1 are at different heights.

In some embodiments, a part of the first gas inlet pipe 602 has a third oil return hole 6023 connected to the separation chamber 6011, and a part of the second gas outlet pipe 603 has a fourth oil return hole 6033 connected to the separation chamber. The third oil return hole 6023 is above the first oil return hole 6022, or the third oil return hole 6023 and the first oil return hole 6022 are at a same height. The fourth oil return hole 6033 is above the second oil return hole 6032, or the fourth oil return hole 6033 and the second oil return hole 6032 are at a same height.

For example, as shown in FIGS. 1 to 3, a distance between the third oil return hole 6023 (*b*) and the bottom wall surface of the separation chamber 6011 is L5, and a distance between the fourth oil return hole 6033 (*d*) and the bottom wall surface of the separation chamber 6011 is L6, in which L5≥L2 and L6≥L4.

As a result, when the first compressor 1 fails to return oil in time through the first oil return hole 6022 or when oil cannot return through the first oil return hole 6022 for some reason, the first compressor 1 can achieve oil return through the third oil return hole 6023; and when the second compressor 2 fails to return oil in time through the second oil return hole 6032 or when oil cannot return through the second oil return hole 6032 for some reason, the second compressor 2 can achieve oil return through the fourth oil return hole 6033. It is possible to further prevent the compressor from being worn out for lack of lubrication due to untimely oil return or inability to return oil, to improve the reliability of the compressor assembly.

In some embodiments, the third oil return hole 6023 and the fourth oil return hole 6033 are at the same height.

For example, when the bottom wall surface of the accommodation chamber 5011 and the bottom wall surface of the separation chamber 6011 are at the same height, L5=L6.

Hence, it is possible to further relieve or even avoid the problem of the large refrigerant distribution deviation caused by the different capacities of the first compressor 1 and the second compressor 2, which is conducive to further improving the reliability of the compressor assembly.

In some embodiments, one end of the gas balance pipe 8 is above the third oil return hole 6023 or at a same height as the third oil return hole 6023, and is above the fourth oil return hole 6033 or at a same height as the fourth oil return hole 6033; the other end of the gas balance pipe 8 is above the third oil return hole 6023 or at a same height as the third oil return hole 6023, and is above the fourth oil return hole 6033 or at a same height as the fourth oil return hole 6033.

For example, as shown in FIGS. 1 and 3, when the bottom wall surface of the accommodation chamber 5011 and the bottom wall surface of the separation chamber 6011 are at the same height, a distance between one end (g) of the gas balance pipe 8 and the bottom wall surface of the accommodation chamber 5011 is L7, in which L7≥L5, and a distance between the other end (h) of the gas balance pipe 8 and the bottom wall surface of the separation chamber 6011 is L8, in which L8≥L6.

Therefore, the compressor assembly according to embodiments of the present disclosure can better utilize the gas balance pipe 8 to achieve gas balance in the accommodation chamber 5011 and the separation chamber 6011 and utilize the liquid balance pipe 7 to achieve liquid balance in the accommodation chamber 5011 and the separation chamber 6011, which will be conducive to further improving the reliability of the compressor assembly.

In some embodiments, the third oil return hole 6023 is between one end of the gas balance pipe 8 and one end of the liquid balance pipe 7 in the up-down direction, and the third oil return hole 6023 is between the other end of the gas balance pipe 8 and the other end of the liquid balance pipe 7 in the up-down direction. The fourth oil return hole 6033 is between one end of the gas balance pipe 8 and one end of the liquid balance pipe 7 in the up-down direction, and the fourth oil return hole 6033 is between the other end of the gas balance pipe 8 and the other end of the liquid balance pipe 7 in the up-down direction.

For example, when the bottom wall surface of the accommodation chamber 5011 and the bottom wall surface of the separation chamber 6011 are at the same height, L7>L5>L1 and L8>L6>L2.

Thus, the reliability of the compressor assembly can be further enhanced.

In some embodiments, the bottom wall surface of the accommodation chamber 5011 and the bottom wall surface of the separation chamber 6011 are at the same height. One end of the liquid balance pipe 7 is at the same height as the other end of the liquid balance pipe 7, that is, the liquid balance pipe 7 is arranged horizontally. One end of the gas balance pipe 8 is at the same height as the other end of the gas balance pipe 8, that is, the gas balance pipe 8 is arranged horizontally.

Therefore, when the compressor assembly is mounted, it is only necessary to position the bottom wall surface of the accommodation chamber 5011 and the bottom wall surface of the separation chamber 6011 at the same installation height, which facilitates the installation of the compressor assembly.

In some embodiments, a part of the first gas inlet pipe 602 and a part of the second gas outlet pipe 603 each include a U-shaped portion.

The U-shaped portion includes a first segment, a second segment and an intermediate segment. The first segment and the second segment both extend in the up-down direction. One end of the intermediate segment is connected to a lower end of the first segment, and the other end of the intermediate segment is connected to a lower end of the second segment.

The first oil return hole 6022 is in the intermediate segment of the first gas outlet pipe 602; the third oil return hole 6023 is in the first segment of the first gas outlet pipe 602; the second oil return hole 6032 is in the intermediate segment of the second gas outlet pipe 603; and the fourth oil return hole 6033 is in the first segment of the second gas outlet pipe 603.

An air conditioner outdoor unit 100 according to embodiments of the present disclosure will be described below with reference to the accompanying drawings.

As shown in FIGS. 1 to 3, the air conditioner outdoor unit 100 according to embodiments of the present disclosure includes a four-way valve 9, an outdoor heat exchanger 10, and a compressor assembly.

The four-way valve 9 includes a first interface 901, a second interface 902, a third interface 903, and a fourth interface 904. A first port 1001 of the outdoor heat exchanger 10 is connected to the first interface 901.

The compressor assembly is the compressor assembly described in any of the above embodiments. The first oil separator 3 has a first oil separator outlet 303, and the second oil separator 4 has a second oil separator outlet 403. The first oil separator outlet 303 and the second oil separator outlet 403 are each connected to the second interface 902. The first refrigerant inlet 5021 and the second refrigerant inlet 5031 are each connected to the fourth interface 904.

Therefore, the air conditioner outdoor unit 100 according to embodiments of the present disclosure has advantages such as high operational reliability.

In embodiments of the present disclosure, the air conditioner outdoor unit 100 includes a seventh pipe 17, an eighth pipe 18, a ninth pipe 19, a tenth pipe 20, and an eleventh pipe 21. The first gas inlet pipe 502 and the second gas inlet pipe 503 are each connected to the fourth interface 904 through the seventh pipe 17. One end of the eighth pipe 18 is connected to the first oil separator outlet 303; one end of the ninth pipe 19 is connected to the second oil separator outlet 403; and the other end of the eighth pipe 18 and the other end of the ninth pipe 19 are each connected to the second interface 902 through the tenth pipe 20. The first port 1001 of the outdoor heat exchanger 10 is connected to the first port 901 through the eleventh pipe 21.

An air conditioning system according to embodiments of the present disclosure will be described below with reference to the accompanying drawings.

The air conditioning system according to embodiments of the present disclosure includes an air conditioner outdoor unit and an air conditioner indoor unit. The air conditioner outdoor unit is the air conditioner outdoor unit 100 described in any of the above embodiments. The air conditioner indoor unit includes an indoor heat exchanger. A second port 1002 of the outdoor heat exchanger 10 is connected to a first port of the indoor heat exchanger, and a second port of the indoor heat exchanger is connected to the third interface 903.

Therefore, the air conditioning system according to embodiments of the present disclosure has advantages such as high operational reliability.

In embodiments of the present disclosure, the air conditioning system includes a twelfth pipe 22 and a thirteenth pipe 23. The second port 1002 of the outdoor heat exchanger 10 is connected to the first port of the indoor heat exchanger through the twelfth pipe 22, and the second port of the indoor heat exchanger is connected to the third interface 903 through the thirteenth pipe 23.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner connection or interaction of two elements, according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Further, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described connected to the embodiment or example is included in at least one embodiment or example of the present disclosure. Thus, the above terms throughout this specification are not necessarily referring to the same embodiment or example of the present disclosure. Further, the particular features, structures, materials, or characteristics may be combined in any suitable manner in one or more embodiments or examples. Moreover, integration and combination of the different embodiments or examples and the features of the different embodiments or examples described in this specification without contradicting each other.

Although embodiments of the present disclosure have been shown and described, the above embodiments are merely exemplary and are not intended to limit the present disclosure, and various changes, modifications, alternatives and variations may be made to the embodiments within the scope of the present disclosure.

What is claimed is:

1. A compressor assembly, comprising:

a first compressor comprising a first exhaust port and a first gas return port;

a second compressor comprising a second exhaust port and a second gas return port;

a first oil separator comprising a first oil outlet and a first oil separator inlet, the first oil separator inlet being connected to the first exhaust port;

a second oil separator comprising a second oil outlet and a second oil separator inlet, the second oil separator inlet being connected to the second exhaust port;

a storage container having an accommodation chamber and comprising a refrigerant inlet connected to the accommodation chamber, wherein the first oil outlet and the second oil outlet are each connected to the refrigerant inlet;

a gas-liquid separator having a separation chamber and comprising a first gas separator outlet, a second gas separator outlet, a first oil return hole and a second oil return hole, wherein the first gas separator outlet and the first oil return hole are each connected to the first gas return port, and the second gas separator outlet and the second oil return hole are each connected to the second gas return port; and a liquid balance pipe and a gas balance pipe above the liquid balance pipe, wherein a first end of the liquid balance pipe and a first end of the gas balance pipe are both connected to the accommodation chamber, while a second end of the liquid balance pipe and a second end of the gas balance pipe are both connected to the separation chamber;

wherein the compressor assembly is configured to distribute a refrigeration oil and a refrigerant to enter the accommodation chamber of the storage container firstly, and then enter the separation chamber of the gas-liquid separator through the liquid balance pipe and the gas balance pipe.

2. The compressor assembly according to claim 1, wherein the storage container comprises a casing, and the accommodation chamber is defined in the casing;

the gas-liquid separator comprises:

a cylinder, the separation chamber being defined in the cylinder; and a first gas outlet pipe and a second gas outlet pipe, wherein a first portion of the first gas outlet pipe and a first portion of the second gas outlet pipe both extend into the separation chamber; the first oil return hole is in the first portion of the first gas outlet pipe, and the first gas separator outlet is in a second portion of the first gas outlet pipe; the second oil return hole is in the first portion of the second gas outlet pipe, and the second gas separator outlet is in a second portion of the second gas outlet pipe;

wherein the first end of the liquid balance pipe is below the first oil return hole or at a same height as the first oil return hole, and the first end of the liquid balance pipe is below the second oil return hole or at a same height as the second oil return hole;

the second end of the liquid balance pipe is below the first oil return hole or at a same height as the first oil return hole, and the second end of the liquid balance pipe is below the second oil return hole or at a same height as the second oil return hole.

3. The compressor assembly according to claim 2, wherein the first portion of the first gas outlet pipe comprises a third oil return hole connected to the separation chamber, and the first portion of the second gas outlet pipe comprises a fourth oil return hole connected to the separation chamber, wherein the third oil return hole is above the first oil return hole or at a same height as the first oil return hole; and the fourth oil return hole is above the second oil return hole or at a same height as the second oil return hole.

4. The compressor assembly according to claim 3, wherein the first end of the gas balance pipe is above the third oil return hole or at a same height as the third oil return hole, and the first end of the gas balance pipe is above the fourth oil return hole or at a same height as the fourth oil return hole;

the second end of the gas balance pipe is above the third oil return hole or at a same height as the third oil return hole, and the second end of the gas balance pipe is above the fourth oil return hole or at a same height as the fourth oil return hole.

5. The compressor assembly according to claim 4, wherein the third oil return hole is between the first end of the gas balance pipe and the first end of the liquid balance pipe in an up-down direction, and the third oil return hole is between the second end of the gas balance pipe and the second end of the liquid balance pipe in the up-down direction; and the fourth oil return hole is between the first end of the gas balance pipe and the first end of the liquid balance pipe in the up-down direction, and the fourth oil return hole is between the second end of the gas balance pipe and the second end of the liquid balance pipe in the up-down direction.

6. The compressor assembly according to claim 1, wherein the first oil return hole and the second oil return hole are at a same height; and/or a bottom wall surface of the accommodation chamber and a bottom wall surface of the separation chamber are at a same height, the first end of the liquid balance pipe and the second end of the liquid balance pipe are at a same height, and the first end of the gas balance pipe and the second end of the gas balance pipe are at a same height.

7. The compressor assembly according to claim 3, wherein the third oil return hole and the fourth oil return hole are at a same height.

8. The compressor assembly according to claim 2, wherein the storage container comprises a first gas inlet pipe and a second gas inlet pipe; a first portion of the first gas inlet pipe and a first portion of the second gas inlet pipe both extend into the accommodation chamber; the first portion of the first gas inlet pipe and the first portion of the second gas inlet pipe are each provided with the refrigerant inlet; the first oil outlet and the second oil outlet are each connected to the refrigerant inlet of the first gas inlet pipe.

9. The compressor assembly according to claim 1, wherein the storage container comprises a first gas inlet pipe and a second gas inlet pipe; a first portion of the first gas inlet pipe and a first portion of the second gas inlet pipe both extend into the accommodation chamber; the first portion of the first gas inlet pipe and the first portion of the second gas inlet pipe are each provided with the refrigerant inlet; the first oil outlet is connected to the refrigerant inlet of the first gas inlet pipe, and the second oil outlet is connected to the refrigerant inlet of the second gas inlet pipe.

10. The compressor assembly according to claim 3, wherein the first portion of the first gas outlet pipe and the first portion of the second gas outlet pipe each comprise a U-shaped portion, wherein the U-shaped portion comprises:

a first segment and a second segment, the first segment and the second segment extending in an up-down direction; and an intermediate segment, having a first end connected to a lower end of the first segment, and a second end connected to a lower end of the second segment, wherein the first oil return hole is in the intermediate segment of the first gas outlet pipe; the third oil return hole is in the first segment of the first gas outlet pipe; the second oil return hole is in the intermediate segment of the second gas outlet pipe; and the fourth oil return hole is in the first segment of the second gas outlet pipe.

11. An air conditioner outdoor unit, comprising:

a four-way valve, comprising a first interface, a second interface, a third interface, and a fourth interface;

an outdoor heat exchanger, a first port of the outdoor heat exchanger being connected to the first interface; and a compressor assembly, comprising:

a first compressor comprising a first exhaust port and a first gas return port;

a second compressor comprising a second exhaust port and a second gas return port;

a first oil separator comprising a first oil outlet and a first oil separator inlet, the first oil separator inlet being connected to the first exhaust port;

a second oil separator comprising a second oil outlet and a second oil separator inlet, the second oil separator inlet being connected to the second exhaust port;

a storage container having an accommodation chamber and comprising a refrigerant inlet connected to the accommodation chamber, wherein the first oil outlet and the second oil outlet are each connected to the refrigerant inlet;

a gas-liquid separator having a separation chamber and comprising a first gas separator outlet, a second gas separator outlet, a first oil return hole and a second oil return hole, wherein the first gas separator outlet and the first oil return hole are each connected to the first gas return port, and the second gas separator outlet and the second oil return hole are each connected to the second gas return port; and a liquid balance pipe and a gas balance pipe above the liquid balance pipe, wherein a first end of the liquid balance pipe and a first end of the gas balance pipe are both connected to the accommodation chamber, while a second end of the liquid balance pipe and a second end of the gas balance pipe are both connected to the separation chamber, wherein the first oil separator comprises a first oil separator outlet, and the second oil separator comprises a second oil separator outlet; the first oil separator outlet and the second oil separator outlet are each connected to the second interface; and the refrigerant inlet is connected to the fourth interface;

wherein the compressor assembly is configured to distribute a refrigeration oil and a refrigerant to enter the accommodation chamber of the storage container firstly, and then enter the separation chamber of the gas-liquid separator through the liquid balance pipe and the gas balance pipe.

12. An air conditioning system, comprising:

an air conditioner outdoor unit, comprising:

a four-way valve, comprising a first interface, a second interface, a third interface, and a fourth interface;

an outdoor heat exchanger, a first port of the outdoor heat exchanger being connected to the first interface; and a compressor assembly, comprising:

a first compressor comprising a first exhaust port and a first gas return port;

a second compressor comprising a second exhaust port and a second gas return port;

a first oil separator comprising a first oil outlet and a first oil separator inlet, the first oil separator inlet being connected to the first exhaust port;

a second oil separator comprising a second oil outlet and a second oil separator inlet, the second oil separator inlet being connected to the second exhaust port;

a storage container having an accommodation chamber and comprising a refrigerant inlet connected to the accommodation chamber, wherein the first oil outlet and the second oil outlet are each connected to the refrigerant inlet;

a gas-liquid separator having a separation chamber and comprising a first gas separator outlet, a second gas separator outlet, a first oil return hole and a second oil return hole, wherein the first gas separator outlet and the first oil return hole are each connected to the first gas return port, and the second gas separator outlet and the second oil return hole are each connected to the second gas return port; and a liquid balance pipe and a gas balance pipe above the liquid balance pipe, wherein a first end of the liquid balance pipe and a first end of the gas balance pipe are both connected to the accommodation chamber, while a second end of the liquid balance pipe and a second end of the gas balance pipe are both connected to the separation chamber, wherein the first oil separator comprises a first oil separator outlet, and the second oil separator comprises a second oil separator outlet; the first oil separator outlet and the second oil separator outlet are each connected to the second interface; and the refrigerant inlet is connected to the fourth interface; and an air conditioner indoor unit comprising an indoor heat exchanger, wherein a second port of the outdoor heat exchanger is connected to a first port of the indoor heat exchanger, and a second port of the indoor heat exchanger is connected to the third interface;

wherein the compressor assembly is configured to distribute a refrigeration oil and a refrigerant to enter the accommodation chamber of the storage container firstly, and then enter the separation chamber of the gas-liquid separator through the liquid balance pipe and the gas balance pipe.

13. The air conditioning system according to claim 12, wherein the storage container comprises a casing, and the accommodation chamber is defined in the casing;

the gas-liquid separator comprises:

a cylinder, the separation chamber being defined in the cylinder; and a first gas outlet pipe and a second gas outlet pipe, wherein a first portion of the first gas outlet pipe and a first portion of the second gas outlet pipe both extend into the separation chamber; the first oil return hole is in the first portion of the first gas outlet pipe, and the first gas separator outlet is in a second portion of the first gas outlet pipe; the second oil return hole is in the first portion of the second gas outlet pipe, and the second gas separator outlet is in a second portion of the second gas outlet pipe;

wherein the first end of the liquid balance pipe is below the first oil return hole or at a same height as the first oil return hole, and the first end of the liquid balance pipe is below the second oil return hole or at a same height as the second oil return hole;

the second end of the liquid balance pipe is below the first oil return hole or at a same height as the first oil return hole, and the second end of the liquid balance pipe is below the second oil return hole or at a same height as the second oil return hole.

14. The air conditioning system according to claim 13, wherein the first portion of the first gas outlet pipe comprises a third oil return hole connected to the separation chamber, and the first portion of the second gas outlet pipe comprises a fourth oil return hole connected to the separation chamber, wherein the third oil return hole is above the first oil return hole or at a same height as the first oil return hole; and the fourth oil return hole is above the second oil return hole or at a same height as the second oil return hole.

15. The air conditioning system according to claim 14, wherein the first end of the gas balance pipe is above the third oil return hole or at a same height as the third oil return hole, and the first end of the gas balance pipe is above the fourth oil return hole or at a same height as the fourth oil return hole;

the second end of the gas balance pipe is above the third oil return hole or at a same height as the third oil return hole, and the second end of the gas balance pipe is above the fourth oil return hole or at a same height as the fourth oil return hole.

16. The air conditioning system according to claim 15, wherein the third oil return hole is between the first end of the gas balance pipe and the first end of the liquid balance pipe in an up-down direction, and the third oil return hole is between the second end of the gas balance pipe and the second end of the liquid balance pipe in the up-down direction; and the fourth oil return hole is between the first end of the gas balance pipe and the first end of the liquid balance pipe in the up-down direction, and the fourth oil return hole is between the second end of the gas balance pipe and the second end of the liquid balance pipe in the up-down direction.

17. The air conditioning system according to claim 12, wherein the first oil return hole and the second oil return hole are at a same height; and/or a bottom wall surface of the accommodation chamber and a bottom wall surface of the separation chamber are at a same height, the first end of the liquid balance pipe and the second end of the liquid balance pipe are at a same height, and the first end of the gas balance pipe and the second end of the gas balance pipe are at a same height.

18. The air conditioning system according to claim 14, wherein the third oil return hole and the fourth oil return hole are at a same height.

19. The air conditioning system according to claim 13, wherein the storage container comprises a first gas inlet pipe and a second gas inlet pipe; a first portion of the first gas inlet pipe and a first portion of the second gas inlet pipe both extend into the accommodation chamber; the first portion of the first gas inlet pipe and the first portion of the second gas inlet pipe are each provided with the refrigerant inlet; the first oil outlet and the second oil outlet are each connected to the refrigerant inlet of the first gas inlet pipe.

20. The air conditioning system according to claim 12, wherein the storage container comprises a first gas inlet pipe and a second gas inlet pipe; a first portion of the first gas inlet pipe and a first portion of the second gas inlet pipe both extend into the accommodation chamber; the first portion of the first gas inlet pipe and the first portion of the second gas inlet pipe are each provided with the refrigerant inlet; the first oil outlet is connected to the refrigerant inlet of the first gas inlet pipe, and the second oil outlet is connected to the refrigerant inlet of the second gas inlet pipe.

* * * * *